US010766747B2

(12) United States Patent
Ogura

(10) Patent No.: US 10,766,747 B2
(45) Date of Patent: Sep. 8, 2020

(54) ABNORMALITY DETECTION APPARATUS FOR PASSENGER CONVEYOR

(71) Applicant: Mitsubishi Electric Corporation, Tokyo (JP)

(72) Inventor: Kenji Ogura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/617,521

(22) PCT Filed: Jul. 19, 2017

(86) PCT No.: PCT/JP2017/026075
§ 371 (c)(1),
(2) Date: Nov. 27, 2019

(87) PCT Pub. No.: WO2019/016884
PCT Pub. Date: Jan. 24, 2019

(65) Prior Publication Data

US 2020/0180915 A1 Jun. 11, 2020

(51) Int. Cl.
*B66B 29/00* (2006.01)
*B66B 27/00* (2006.01)
*B66B 23/12* (2006.01)

(52) U.S. Cl.
CPC ..... *B66B 29/00* (2013.01); *B66B 23/12* (2013.01); *B66B 27/00* (2013.01)

(58) Field of Classification Search
CPC ..... B66B 23/12; B66B 27/00; B66B 29/00; B66B 29/005
(Continued)

(56) References Cited

U.S. PATENT DOCUMENTS 5,316,121 A * 5/1994 Zaharia ..... B66B 29/005 198/323
6,601,688 B1 * 8/2003 Stoxen ..... B66B 29/005 198/322
(Continued)

FOREIGN PATENT DOCUMENTS

JP 55-20370 U 2/1980
JP 2006-273549 A 10/2006
(Continued)

OTHER PUBLICATIONS

International Search Report and Written Opinion dated Sep. 12, 2017 for PCT/JP2017/026075 filed on Jul. 19, 2017, 9 pages including English Translation of the International Search Report.

*Primary Examiner* — Gene O Crawford
*Assistant Examiner* — Keith R Campbell
(74) *Attorney, Agent, or Firm* — Xsensus LLP

(57) ABSTRACT

Provided is an abnormality detection apparatus for a passenger conveyor, including: a first sensor arranged at an upper horizontal portion; a second sensor arranged at a lower horizontal portion; and a control device configured to receive respective outputs of the first sensor and the second sensor, wherein the first sensor and the second sensor are each configured to measure a distance to a side surface of each of steps along a traveling direction of each of steps, and wherein the control device is configured to detect abnormality of the passenger conveyor based on a change amount of each of measurement values given by the first sensor and the second sensor.

4 Claims, 5 Drawing Sheets

(58) Field of Classification Search
USPC ..... 198/323, 333
See application file for complete search history.

(56) References Cited

U.S. PATENT DOCUMENTS

| | | | | |
|---|---|---|---|---|
| 9,302,887 | B2 * | 4/2016 | Zeiger | B66B 29/005 |
| 2011/0011700 | A1 * | 1/2011 | Plathin | B66B 29/005<br>198/323 |

FOREIGN PATENT DOCUMENTS

| | | | |
|---|---|---|---|
| JP | 2012-106808 | A | 6/2012 |
| JP | 2016-16926 | A | 2/2016 |

* cited by examiner

ABNORMALITY DETECTION APPARATUS FOR PASSENGER CONVEYOR

CROSS-REFERENCE TO RELATED APPLICATION

The present application is based on PCT filing PCT/JP2017/026075, filed Jul. 19, 2017, the entire contents of which are incorporated herein by reference.

TECHNICAL FIELD

The present invention relates to an apparatus configured to detect abnormality in a drive system for steps based on a posture of a step of a passenger conveyor.

BACKGROUND ART

Hitherto, a gap is defined between each of steps and each of skirt guards of a passenger conveyor so as to prevent contact of each of the steps with the skirt guards at the time of traveling. Each of the steps is caused to travel along a traveling direction thereof by step chains which are arranged on both side surfaces of each of the steps. In some cases, each of the step chains is extended due to a temporal change or an external factor. When the step chains are not evenly extended, in some cases, each of the steps may travel while being inclined with respect to the traveling direction. In such a case, the side surfaces of each of the steps may be brought into contact with the skirt guards and cause damage on the skirt guard.

In view of the circumstance described above, there has been disclosed an apparatus having the following configuration. Specifically, at a position at which step horizontally move and at which postures of the steps are not corrected, a distance sensor configured to measure a distance to a side surface of the step is disposed, and a change in width of a gap between the steps is measured based on measurement values given by the distance sensor, to thereby detect extension of chains for the steps (for example, see Patent Literature 1). Moreover, there has been disclosed an apparatus having the following configuration. Specifically, sensors are arranged on one end side and another end side of a landing plate, and it is determined that inclination of a step surface is abnormal when a time difference in passage of the step surface through the sensors exceeds a threshold value (for example, see Patent Literature 2).

CITATION LIST

Patent Literature

[PTL 1] JP 2006-273549 A
[PTL 2] JP 2016-16926 A

SUMMARY OF INVENTION

Technical Problem

In the apparatus described in Patent Literature 1, the extension of the step chains is detected based only on a change in gap between the steps. However, the change in gap between the steps is not caused only by the extension of the step chains. Moreover, even when the step chains are extended, the change in gap between adjacent steps is small, and hence the extension of the step chains cannot accurately be detected based on the change in gap between the steps.

Moreover, in the apparatus of Patent Literature 2, the sensors are arranged on both the right and left sides of the landing plate. However, in general, at the position of the landing plate, a position of the step is regulated in order to avoid contact between the step and a comb portion. Therefore, at the position of the landing plate, abnormality of the step cannot accurately be detected.

The present invention has been made to solve the problems described above, and obtains an abnormality detection apparatus for a passenger conveyor which is configured to detect wear of guide members of a step and extension of step chains based on a temporal change in traveling state of the step at an upper horizontal portion and a lower horizontal portion.

Solution to Problem

According to one embodiment of the present invention, there is provided an abnormality detection apparatus for a passenger conveyor, including: a first sensor arranged at an upper horizontal portion; a second sensor arranged at a lower horizontal portion; and a control device configured to receive respective outputs of the first sensor and the second sensor, wherein the first sensor and the second sensor are each configured to measure a distance to a side surface of each of steps along a traveling direction of each of steps, and wherein the control device is configured to detect abnormality of the passenger conveyor based on a change amount of each of measurement values given by the first sensor and the second sensor.

Advantageous Effects of Invention

According to the present invention, a traveling state of a step and a change in traveling state are detected based on a posture of the step at an upper horizontal portion and a posture of the step at a lower horizontal portion. With this, abnormality of guide members and step chains can be detected.

DESCRIPTION OF EMBODIMENTS

Now, an abnormality detection apparatus for a passenger conveyor according to a preferred embodiment of the present invention is described with reference to the drawings.

First Embodiment

Figure 1:
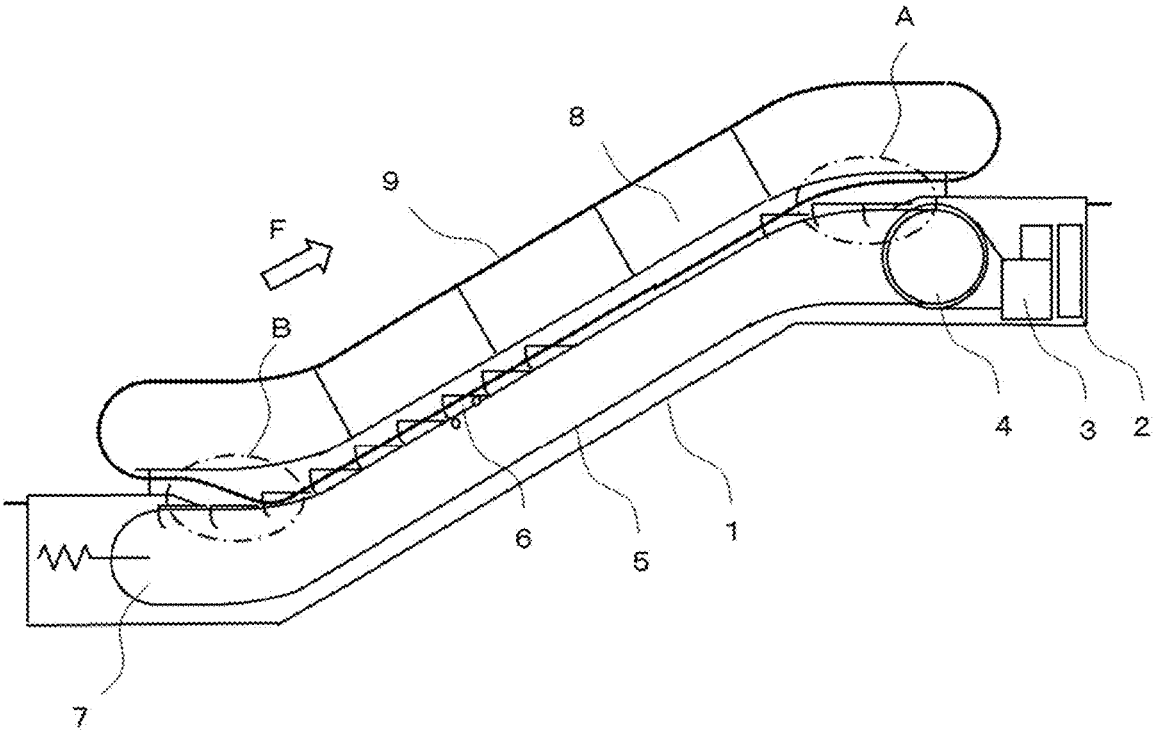
FIG. 1 is a schematic view for illustrating a passenger conveyor on which an abnormality detection apparatus according to a first embodiment of the present invention is arranged.
Figure 2:
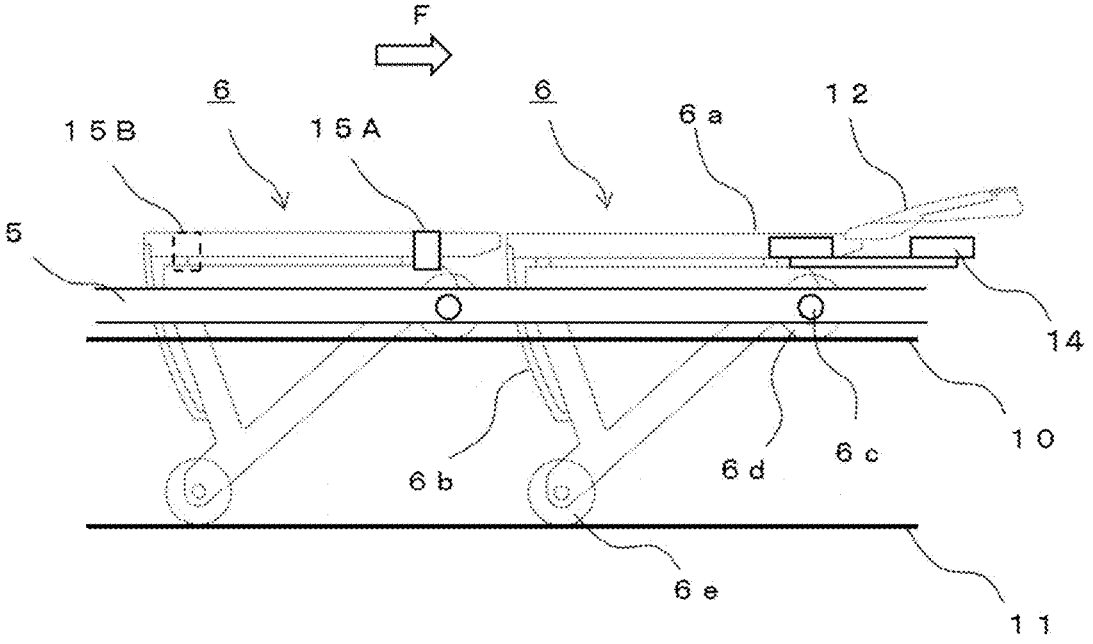
FIG. 2 is a view for illustrating the upper horizontal portion of FIG. 1.
Figure 3:
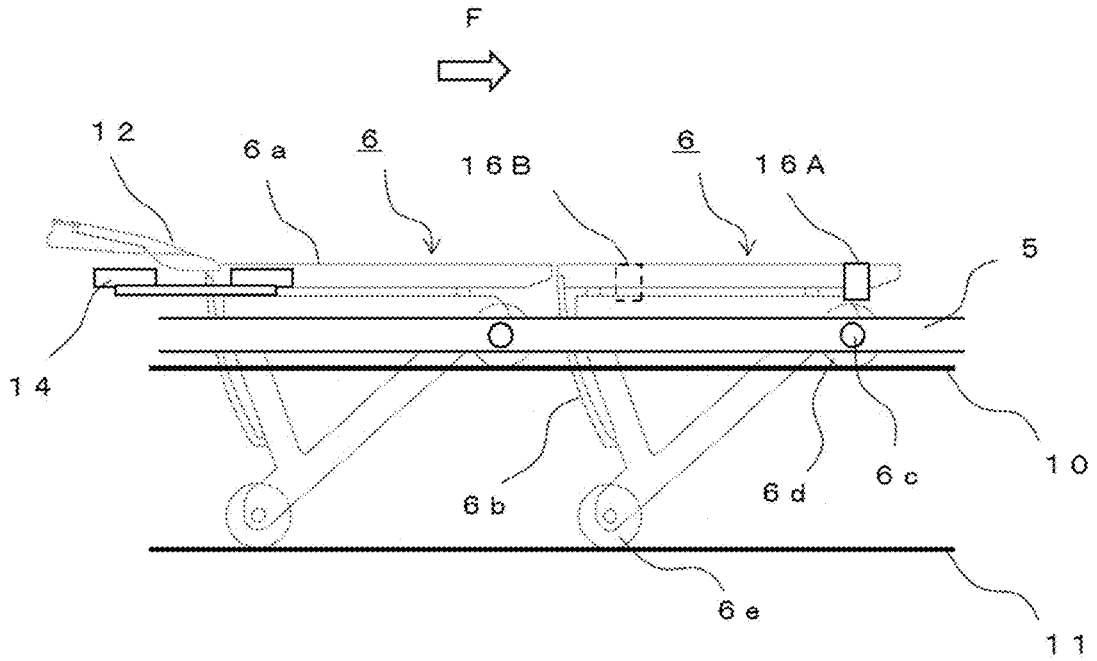
FIG. 3 is a view for illustrating the lower horizontal portion of FIG. 1.

FIG. 1 is a schematic view for illustrating a passenger conveyor on which an abnormality detection apparatus according to a first embodiment of the present invention is arranged. FIG. 2 is a partial enlarged view for illustrating an upper horizontal portion A of FIG. 1. FIG. 3 is a partial enlarged view for illustrating a lower horizontal portion B of FIG. 1. Moreover, FIG. 4 is a top view of FIG. 2, and is an illustration in which a traveling direction of a step corresponds to an up-and-down direction.

As illustrated in FIG. 1, the passenger conveyor includes a truss 1, a control panel 2, a drive unit 3, a step sprocket 4 arranged at an upper reversing portion, a step chain 5 wound around the step sprocket 4, a plurality of steps 6, a lower reversing portion 7, a plurality of balustrades 8, and a moving handrail 9. The step sprocket 4 is rotated by the drive unit 3 which is subjected to operation control by the control panel 2. In FIG. 1, one side of the passenger conveyor is illustrated. However, another side also has a similar configuration, and two step sprockets 4, two step chains 5 respectively wound around the two step sprockets 4, and two moving handrails 9 are arranged on both sides of the plurality of steps 6. The plurality of steps 6 are driven to circulate with use of the two step chains 5 respectively wound around the two step sprockets 4.

As illustrated in FIG. 2 and FIG. 3, the plurality of steps 6 each include a step surface 6*a*, a riser 6*b*, a step shaft 6*c*, driving rollers 6*d*, and a pair of trailing rollers 6*e*. The step surface 6*a* allows a passenger to stand thereon. The riser 6*b* is an upright part of the step 6. The step shaft 6*c* is coupled to the two step chains 5 at a constant pitch. The driving rollers 6*d* are mounted to both end portions of the step shaft 6*c*, respectively. The pair of trailing rollers 6*e* are mounted on the riser 6*b* side of the step 6.

Figure 4:
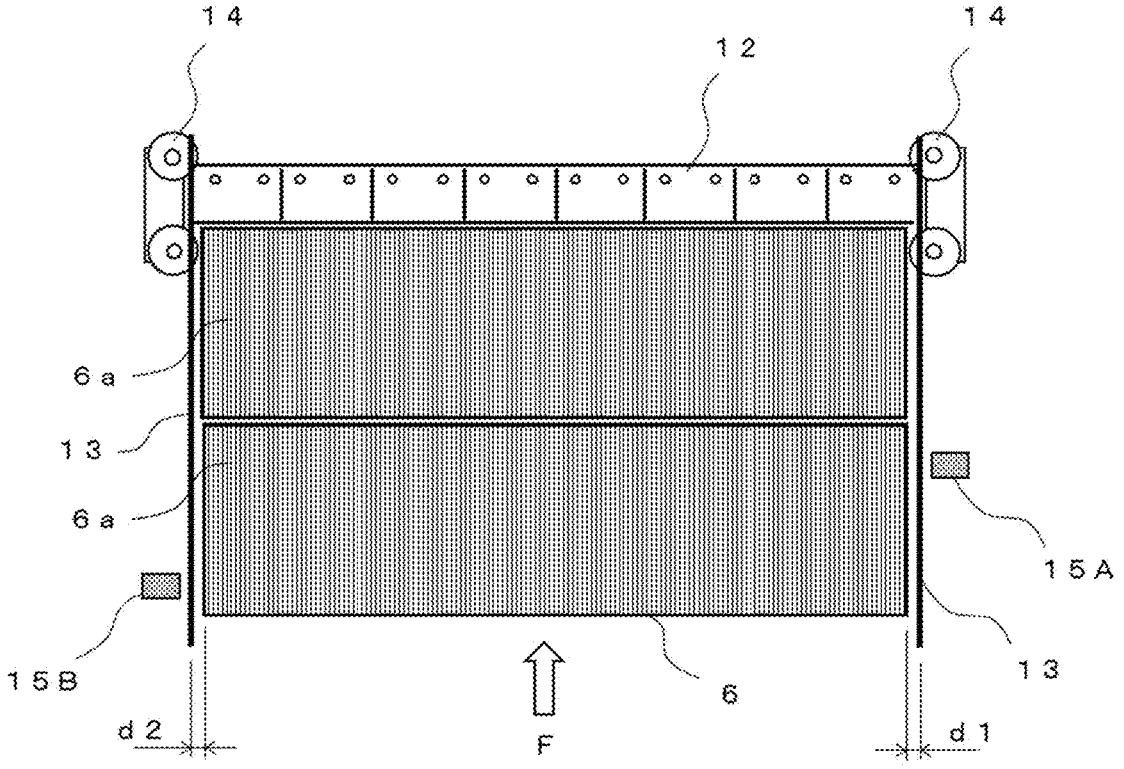
FIG. 4 is a top view for illustrating the upper horizontal portion of the passenger conveyor at which the abnormal detection apparatus according to the first embodiment is arranged.

When the passenger conveyor performs an operation of moving upward in a traveling direction F indicated by the arrows illustrated in FIG. 2 to FIG. 4, at the upper horizontal portion A illustrated in FIG. 2 and FIG. 4, a plurality of grooves of the step surface 6*a*, with the driving rollers 6*d* side being located on a front side, mesh with a comb portion 12 and enter an inside of the truss 1. Moreover, at the lower horizontal portion B illustrated in FIG. 3, a plurality of grooves of the step surface 6*a*, with the driving rollers 6*d* side being located on the front side, mesh with a comb portion 12 and come out from the inside of the truss 1.

As illustrated in FIG. 2 and FIG. 3, the driving rollers 6*d* of each of the steps 6 travel on driving rails 10 arranged in the truss 1, and the trailing rollers 6*e* travel on trailing rails 11 arranged in the truss 1. Moreover, as illustrated in FIG. 4, each of the steps 6 travels while maintaining clearances d1 and d2 with respect to a pair of skirt guards 13 arranged along the traveling direction F of each of the steps 6. Two side rollers 14 are arranged on each of one end side and another end side in a direction perpendicular to the traveling direction F of each of the steps 6. The side rollers 14 correct positional deviation of each of the steps 6 in the direction perpendicular to the traveling direction F, to thereby prevent the plurality of grooves formed in the step surface 6*a* of each of the steps 6 from interfering with the comb portions 12.

As illustrated in FIG. 4, at positions on the upper horizontal portion A at which each of the steps 6 is yet to be corrected in position by the side rollers 14, there are arranged distance sensors 15A and 15B constituting the abnormality detection apparatus according to the first embodiment. Description is made herein with regard to only the upper horizontal portion A, but the lower horizontal portion B also has a similar configuration.

The distance sensor 15A is arranged on one side in the direction perpendicular to the traveling direction F of each of the steps 6 so as to be apart from a side surface of each of the steps 6 by a certain distance. Moreover, the distance sensor 15B is arranged on another side in the direction perpendicular to the traveling direction F of each of the steps 6 so as to be apart from each of the steps 6 by a certain distance. The distance sensors 15A and 15B are each constituted of a non-contact sensor such as an optical reflection type sensor or an ultrasonic sensor. The distance sensors 15A and 15B are configured to simultaneously measure the distances to the side surfaces of the same step 6 in a continuous manner or an intermittent manner during traveling.

The distance sensors 15A and 15B are fixed to the truss 1 (not shown) while being located apart from each other in the traveling direction F within a range in which the distances to the side surfaces of the same step 6 can simultaneously be measured. As described above, through the simultaneous measurement of the distances to the side surfaces of the same step 6 with use of the distance sensors 15A and 15B being arranged apart from each other in the traveling direction F, inclination of each of the steps 6 in a horizontal plane and a positional deviation amount of each of the steps 6 in the direction perpendicular to the traveling direction F are detected. At the lower horizontal portion B, there are arranged distance sensors 16A and 16B similarly to the distance sensors 15A and 15B arranged at the upper horizontal portion A.

Figure 5:
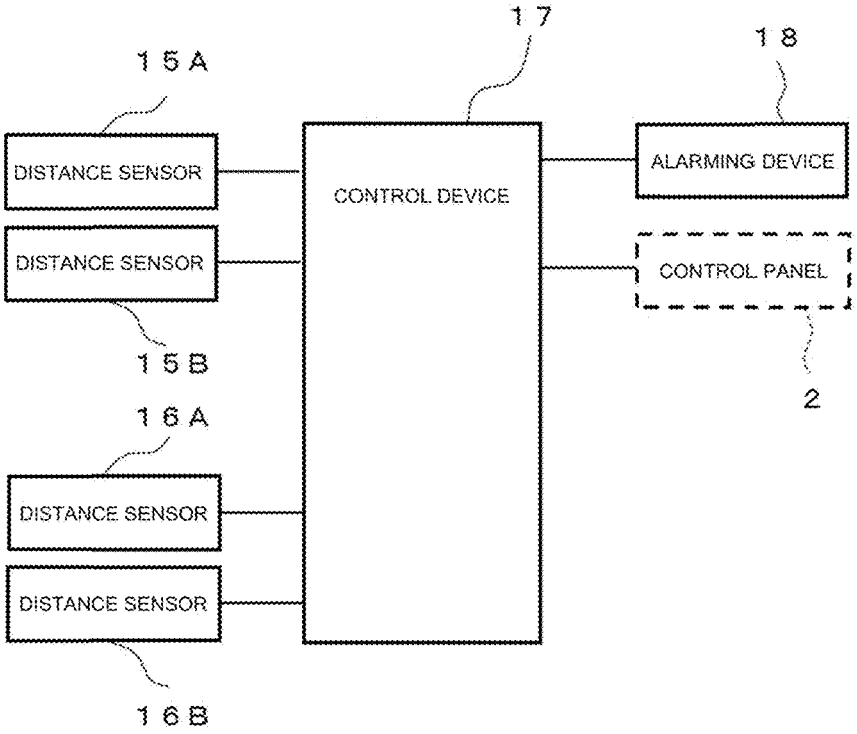
FIG. 5 is a block diagram for illustrating a configuration of the abnormality detection apparatus for a passenger conveyor according to the first embodiment.

Next, with reference to FIG. 5 to FIG. 10, actions of the abnormality detection apparatus for a passenger conveyor is described. FIG. 5 is a block diagram for illustrating the abnormality detection apparatus for a passenger conveyor. As illustrated in FIG. 5, the abnormality detection apparatus for a passenger conveyor includes the distance sensors 15A and 15B arranged at the upper horizontal portion A, the distance sensors 16A and 16B arranged at the lower horizontal portion B, a control device 17, and an alarming device 18. Eased on measurement values given by the distance sensors 15A, 15B, 16A, and 16B, the control device 17 determines whether a posture of each of the steps 6 falls within a normal range or whether the posture of each of the steps 6 is abnormal. When it is determined that a posture of at least one step 6 among the steps 6 is abnormal, the control device 17 outputs a signal to the alarming device 18 and gives notification about the abnormality to a manager. Further, the control device 17 outputs an abnormality signal indicating occurrence of the abnormality in the passenger conveyor to the control panel 2 of the passenger conveyor to perform emergency stop on the drive unit 3 of the passenger conveyor through the control panel 2.

Figure 6:
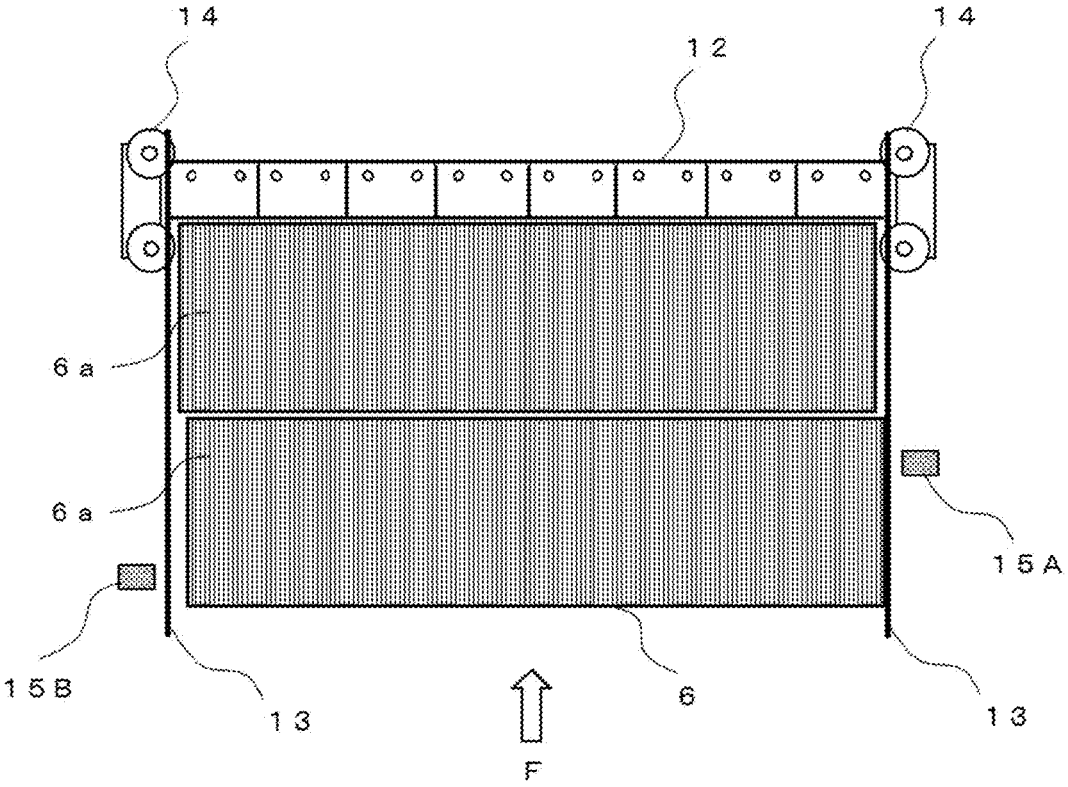
FIG. 6 is a view for illustrating a state in which, at the upper horizontal portion of the passenger conveyor at which the abnormality detection apparatus according to the first embodiment is arranged, a step is deviated in a direction perpendicular to a traveling direction.

FIG. 6 is an illustration of a state in which, at the upper horizontal portion A, one of the steps 6 is deviated in position in a direction of approaching the distance sensor 15A. On this occasion, when the distances to the side surfaces of the step 6 having been deviated in position are simultaneously measured with use of the distance sensors 15A and 15B, a measurement value given by the distance sensor 15A is smaller than that of a normal state, and a measurement value given by the distance sensor 15B is larger than that of the normal state. In contrast, when one of the steps 6 is deviated in position in a direction of approaching the distance sensor 15B, a measurement value given by the distance sensor 15A is larger than that of the normal state, and a measurement value given by the distance sensor 15B is smaller than that of the normal state. As described above, through the simultaneous measurement of the distances to the side surfaces of each of the steps 6 with use of the distance sensors 15A and 15B, a positional deviation amount of each of the steps 6 in the direction perpendicular to the traveling direction F can be detected.

Figure 7A:
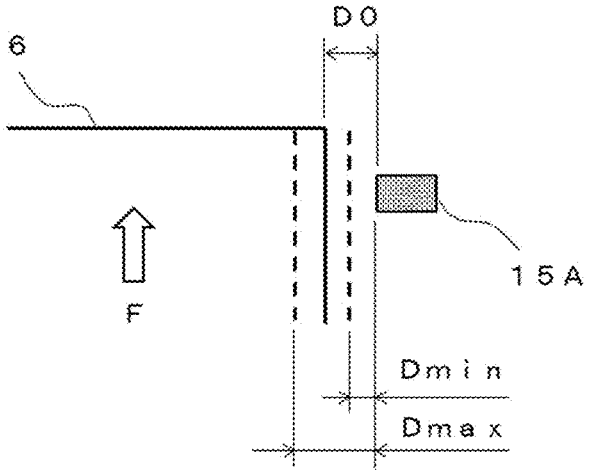
FIG. 7A is a view for illustrating a positional relationship between the step and a distance sensor in the passenger conveyor on which the abnormality detection apparatus according to the first embodiment is arranged.
Figure 7B:
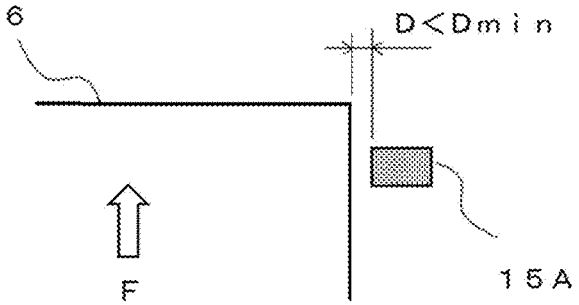
FIG. 7B is a view for illustrating a positional relationship between the distance sensor and the step in the passenger conveyor on which the abnormality detection apparatus according to the first embodiment is arranged.

FIG. 7A and FIG. 7B are each a view for illustrating a positional relationship between the step 6 and the distance sensor 15A. The solid lines illustrated in FIG. 7A indicate the step located at a reference position. A distance between the side surface of the step 6 and the distance sensor 15A in FIG. 7A corresponds to a reference value D0. The two broken lines having the side surface of the step 6 located therebetween in FIG. 7A indicate an allowable range of the positional deviation of the step 6. A distance from the distance sensor 15A to the side surface of the step 6 in FIG. 7A given when the step 6 is deviated most in a direction of approaching the distance sensor 15A within the allowable range corresponds to Dmin. Moreover, a distance from the distance sensor 15A to the side surface of the step 6 given when the step 6 is deviated most in a direction of separating from the distance sensor 15A within the allowable range corresponds to Dmax.

FIG. 7B is an illustration of a case in which the step 6 has been deviated in the direction of approaching the distance sensor 15A beyond the allowable range, and a distance D from the distance sensor 15A to the side surface of the step 6 is smaller than Dmin. The control device 17 compares the distance D, which has been measured by the distance sensor 15A, with Dmax and Dmin, to thereby detect that the distance D is equal to or smaller than the allowable range Dmin. Then, the control device 17 determines that the step 6 of the passenger conveyor has abnormality, and outputs a signal to the alarming device 18 to give notification about the abnormality and sends an abnormality signal to the control panel 2 of the passenger conveyor.

Figure 8:
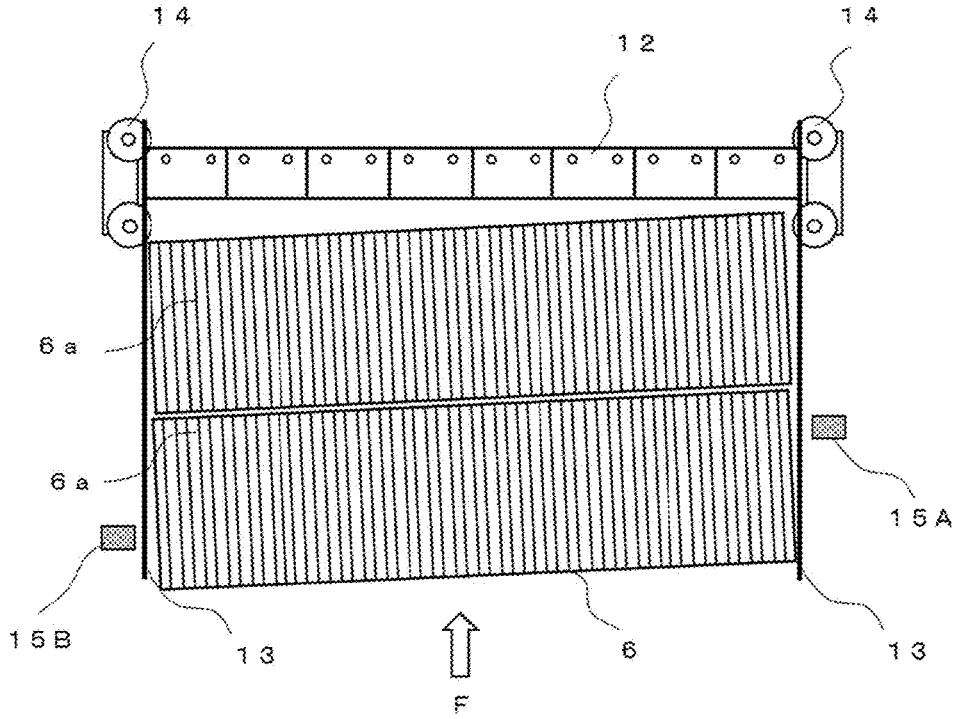
FIG. 8 is a view for illustrating a state in which, at the upper horizontal portion of the passenger conveyor on which the abnormality detection apparatus according to the first embodiment is arranged, the steps are inclined in a horizontal plane.

FIG. 8 is a view for illustrating a state in which, at the upper horizontal portion A, the step 6 is inclined in a direction toward the distance sensor 15B in the horizontal plane with respect to the traveling direction F. On this occasion, when the distances to the side surfaces of the same step 6 are simultaneously measured with use of the distance sensors 15A and 15B, both measurement values of the distance sensors 15A and 15B are large. In contrast, when the step 6 is inclined in a direction toward the distance sensor 15A in the horizontal plane with respect to the traveling direction F, both measurement values of the distance sensors 15A and 15B are small. As described above, through the simultaneous measurement of the distances to the side surfaces of the same steps 6 with use of the distance sensors 15A and 15B, inclination of the step 6 in the horizontal plane and a direction of inclination can be detected.

In FIG. 8, the distance sensor 15A being one of the distance sensor 15A and the distance sensor 15B is arranged so as to be close to the comb portion 12. However, the arrangement of the distance sensor 15A and the distance sensor 15B may be reversed. In this case, when the step 6 is inclined in the direction toward the distance sensor 15B in the horizontal plane with respect to the traveling direction F, both measurement values given by the distance sensors 15A and 15B are small.

Figure 9:
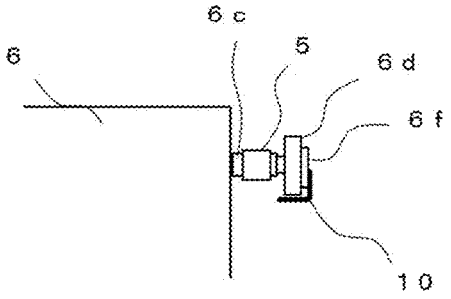
FIG. 9 is a view for illustrating a relationship between a driving roller of the step and a driving rail in the passenger conveyor.

FIG. 9 is a view for illustrating a relationship between the driving roller 6*d* of the step 6 and the driving rail 10. The driving roller 6*d* includes a guide member 6*f* on a side surface thereof located on the driving rail 10 side. The guide member 6*f* is held in abutment against the driving rail 10 and slides on the driving rail 10. Movement of the step 6 in the direction perpendicular to the traveling direction F is regulated by the guide member 6*f* of the driving roller 6*d* and the driving rail 10.

Figure 10:
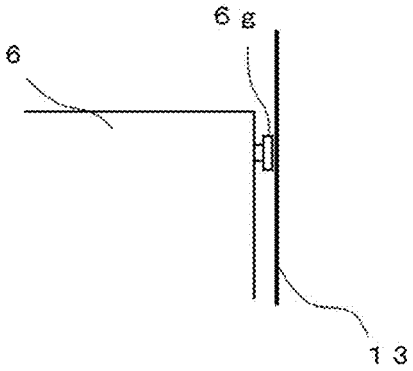
FIG. 10 is a view for illustrating a relationship between a guide member of the step and a skirt guard in the passenger conveyor.

FIG. 10 is an illustration of a relationship between a guide member 6*g* mounted to the side surface of each of the steps 6 along the traveling direction F and a skirt guard 13. The guide member 6*g* protrudes from the side surface of each of the steps 6, and is held in abutment against the skirt guard 13, and slides on the skirt guard 13. Movement of each of the steps 6 in the direction perpendicular to the traveling direction F is regulated by the guide member 6*f* and the skirt guard 13.

When the guide member 6*f* of the step 6 is worn by the sliding on the driving rail 10, or the guide member 6*g* of the step 6 is worn by the sliding on the skirt guard 13, as illustrated in FIG. 6, the step 6 travels while being deviated in the direction perpendicular to the traveling direction F. Meanwhile, when the two step chains 5 are unevenly extended, illustrated in FIG. 8, each of the steps 6 travels in a state of being inclined in the horizontal plane. Thus, based on a temporal change amount of each of measurement values given by the distance sensors 15A and 15B at the upper horizontal portion A and the distance sensors 16A and 16B at the lower horizontal portion B, abnormality of each of the steps 6 and a cause of the abnormality can be detected.

For example, when the passenger conveyor performs an operation of moving upward, in a case in which, with regard to the same step 6, a measurement value given by the distance sensor 16A at the lower horizontal portion B is large, and a measurement value given by the distance sensor 15A at the upper horizontal portion A is small, it can be understood that each of the steps 6 obliquely travels so as to approach the distance sensor 15A as proceeding from the lower horizontal portion B toward the upper horizontal portion A.

In contrast, with regard to the same step 6, in a case in which the measurement value given by the distance sensor 16A at the lower horizontal portion B is small, and the measurement value given by the distance sensor 15A at the upper horizontal portion A is large, it can be understood that each of the steps 6 obliquely travels so as to separate from the distance sensor 15A as proceeding from the lower horizontal portion B toward the upper horizontal portion A.

Moreover, when the measurement value given by the distance sensor 16A at the lower horizontal portion B and the measurement value given by the distance sensor 15A at the upper horizontal portion A are substantially equal to each other, it can be understood that each of the steps 6 travels substantially straight along the traveling direction F.

As an initial setting of the abnormality detection apparatus, measurement values of distances to the side surfaces of each of the steps 6 measured with use of the distance sensors 15A, 15B, 16A, and 16B under a state in which each of the steps 6 is not deviated in position and is not inclined are each set to the reference value D0. Moreover, for example, threshold values of ±1 mm are set to the temporal change amount of each of the measurement values given by the distance sensors 15A, 15B, 16A, and 16B. Then, with use of the control device 17, a change amount of each of measurement values given by the distance sensors 15A, 15B, 16A, and 16B is compared with the threshold values. Then, the control device 17 determines that abnormality has occurred when a traveling position of each of the steps 6 is changed to be equal to or larger than the threshold value due to wear of the each of the guide members 6*f* and 6*g* or uneven extension of the two step chains 5.

When the guide member 6*f* or 6*g* is worn, each of the steps 6 travels at a position deviated in the direction perpendicular to the traveling direction F while maintaining an initial tendency of traveling. Moreover, when the two step chains 5 are unevenly extended, each of the steps 6 travels in a state of being inclined with respect to the traveling direction F, to thereby obliquely travel with respect to the initial tendency of traveling. With this, based on a change amount of each of the measurement values given by the distance sensors 15A and 15B at the upper horizontal portion A and the distance sensors 16A and 16B at the lower horizontal portion B, a cause of abnormality can be estimated.

When a passenger stands on the step 6, the step 6 may be forced to move rightward and leftward in some cases. Therefore, it is preferred that the measurement of the distances to the side surfaces of the step 6 with use of the distance sensors 15A, 15B, 16A, and 16B be performed by circulating the passenger conveyor several times at the time when no load is applied, such as during a period other than operation hours of the passenger conveyor. Then, for example, a maximum value, a minimum value, and an average value of the measurement values may be calculated and accumulated. Moreover, when the measurement is continuously performed, a measurement value of a clearance between adjacent steps 6 becomes larger, and hence the measurement value of the clearance of each of the steps 6 is not to be included in the measurement values to be accumulated. However, borders of the steps 6 can be detected based on the measurement values of the clearances of the steps 6, and hence the measurement values of the clearances may be used to count the number of steps 6.

As described above, according to the abnormality detection apparatus for a passenger conveyor of the first embodiment, the distance sensor 15A and the distance sensor 15B are arranged at the upper horizontal portion A so as to be apart from each other along the traveling direction F of the step 6, and the distance sensor 16A and the distance sensor 16B are arranged at the lower horizontal portion B so as to be apart from each other along the traveling direction F of the step 6. Further, based on the change amount of each of the measurement values given by the distance sensors 15A, 15B, 16A, and 16B, the positional deviation of the step 6 in the direction perpendicular to the traveling direction F and the inclination of each of the steps 6 in the horizontal plane are detected. Furthermore, with use of the control device 17, each of the measurement values given by the distance sensors 15A, 15B, 16A, and 16B is compared with the threshold values, to thereby determine presence or absence of abnormality and a cause of the abnormality. With this, wear of the guide members 6*f* and 6*g* of the passenger conveyor and uneven extension of the two step chains 5 can be detected, thereby being capable of achieving rationalization of maintenance work.

In the first embodiment, description is made of the example case in which the passenger conveyor performs the operation of moving upward. However, a similar effect can be attained also in a case of performing an operation of moving downward. Moreover, in the first embodiment, the distance sensors 15A and 15B are arranged so as to be opposed to each other in the direction perpendicular to the traveling direction of the step 6, and the distance to the side surface of the step 6 on one side and the distance to the side surface of the step 6 on another side are measured. However, the arrangement of the distance sensors 15A and 15B is not limited to this. For example, the distance sensors 15A, and 15B may be arranged in the same direction perpendicular to the traveling direction of the step 6, to thereby measure the distance to the same side surface. With such a configuration, when each of the steps 6 is deviated in position in the direction perpendicular to the traveling direction F, measurement values given by the distance sensors 15A and 15B may have such a change of being similarly large or being similarly small. Further, when each of the steps 6 is inclined with respect to the traveling direction F, measurement values given by the distance sensors 15A and 15B may be such that one of the measurement values become larger and another of the measurement values become smaller.

In the first embodiment, the two distance sensors 15A and 15B are arranged at the upper horizontal portion A, and the two distance sensors 16A and 16B are arranged at the lower horizontal portion B. However, when measurement is continuously performed, one distance sensor may be arranged at each of the upper horizontal portion A and the lower horizontal portion B. In this case, at each of the upper horizontal portion A and the lower horizontal portion B, an end-to-end distance of the side surface of one step 6 is continuously measured, and the positional deviation of the step 6 in the direction perpendicular to the traveling direction F and the inclination of the step 6 in the horizontal plane can be detected based on a tendency of the change in measurement values.

REFERENCE SIGNS LIST

1 truss, 2 control panel, 3 drive unit, 4 step sprocket, 5 step chain, 6 step, 6*a* step surface, 6*b* riser, 6*c* step shaft, 6*d* driving roller, 6*e* trailing roller, 6*f*, 6*g* guide member, 7 lower reversing portion, 8 balustrade, 9 moving handrail, 10 driving rail, 11 trailing rail, 12 comb portion, 13 skirt guard, 14 side roller, 15A, 15B distance sensor (first sensor, upper sensor), 16A, 16B distance sensor (second sensor, lower sensor), 17 control device, 18 alarming device

The invention claimed is:

1. An abnormality detection apparatus for a passenger conveyor, comprising:

a first sensor arranged at an upper horizontal portion;

a second sensor arranged at a lower horizontal portion; and a control circuit configured to receive respective outputs of the first sensor and the second sensor, wherein the first sensor and the second sensor are each configured to measure a distance to a side surface of each of a plurality of steps along a traveling direction of the plurality of steps, wherein the control circuit is configured to detect abnormality of the passenger conveyor based on a change amount of each of measurement values given by the first sensor and the second sensor, wherein the first sensor includes a pair of upper sensors which are arranged at the upper horizontal portion so as to be apart from each other in the traveling direction of the plurality of steps, and wherein the second sensor includes a pair of lower sensors which are arranged at the lower horizontal portion so as to be apart from each other in the traveling direction of the plurality of steps.

2. The abnormality detection apparatus for a passenger conveyor according to claim 1, wherein the pair of upper sensors are arranged at the upper horizontal portion so as to be apart from each other and be opposed to each other in a direction perpendicular to the traveling direction of the plurality of steps, and wherein the pair of lower sensors are arranged at the lower horizontal portion so as to be apart from each other and be opposed to each other in the direction perpendicular to the traveling direction of the plurality of steps.

3. The abnormality detection apparatus for a passenger conveyor according to claim 1, wherein the control circuit is configured to perform, when the abnormality is detected, at least one of giving notification about the abnormality and stopping an operation.

4. The abnormality detection apparatus for a passenger conveyor according to claim 2, wherein the control circuit is configured to perform, when the abnormality is detected, at least one of giving notification about the abnormality and stopping an operation.

* * * * *